US010738519B2

(12) United States Patent
Eisenschenk et al.

(10) Patent No.: US 10,738,519 B2
(45) Date of Patent: Aug. 11, 2020

(54) HINGE

(71) Applicant: MAGNA STEYR Fahrzeugtechnik AG & Co KG, Graz (AT)

(72) Inventors: Stefan Eisenschenk, Weiz (AT); Werner Koller, Graz (AT)

(73) Assignee: MAGNA STEYR Fahrzeugtechnik AG & Co KG, Graz (AT)

( * ) Notice: Subject to any disclaimer, the term of this patent is extended or adjusted under 35 U.S.C. 154(b) by 0 days.

(21) Appl. No.: 16/204,904

(22) Filed: Nov. 29, 2018

(65) Prior Publication Data

US 2019/0360246 A1 Nov. 28, 2019

(30) Foreign Application Priority Data

Dec. 15, 2017 (EP) ..... 17207673

(51) Int. Cl.
*E05D 11/00* (2006.01)
*E05D 3/02* (2006.01)

(52) U.S. Cl.
CPC ..... *E05D 11/0081* (2013.01); *E05D 3/02* (2013.01); *E05D 2003/025* (2013.01); *E05Y 2800/678* (2013.01); *E05Y 2900/531* (2013.01)

(58) Field of Classification Search
CPC ..... Y10T 16/522; Y10T 16/537; H01R 35/02; H01R 35/04; H01H 3/162; H01H 3/161; H01H 13/10; E05D 11/00; E05D 11/0081; E05D 3/02; E05D 2003/025; E05D 2900/531; E05D 2800/678; E05D 7/00; G06F 1/1681; G06F 1/1683; B21D 53/40
See application file for complete search history.

(56) References Cited

U.S. PATENT DOCUMENTS 531,515 A * 12/1894 Davis ..... H01R 35/04 439/31
1,744,040 A * 1/1930 Elzer ..... E05D 11/0081 439/31
3,431,590 A * 3/1969 Anderson ..... E05D 11/00 16/223
3,622,688 A * 11/1971 Link ..... H01B 17/28 174/142

(Continued)

FOREIGN PATENT DOCUMENTS

CN 87106636 A 7/1988
CN 101169019 A 4/2008

(Continued)

OTHER PUBLICATIONS

Search Report from CNIPA (dated Feb. 21, 2020).

*Primary Examiner* — Chuck Y Mah
(74) *Attorney, Agent, or Firm* — Jordan IP Law, LLC; Todd A. Vaughn

(57) ABSTRACT

A hinge to pivotably connect a motor vehicle door to a body of the motor vehicle. The hinge includes a bolt, a first hinge half rotationally connected to a bolt, a second hinge half, a bushing, composed of an electrically insulating material, arranged on the second hinge half to rotationally connect the second hinge half to the bolt, and an electrically conductive component arranged between the bolt and the second hinge half to bridge the bushing and facilitate electrical contact between the bolt and the second hinge half.

16 Claims, 2 Drawing Sheets

(56) References Cited

U.S. PATENT DOCUMENTS 3,857,625 A * 12/1974 Crane ..... E05D 11/0081 439/31
3,921,225 A * 11/1975 Suska ..... E05D 3/02 16/273
4,116,514 A * 9/1978 Lawrence ..... E05D 5/127 16/223
4,412,711 A * 11/1983 Suska ..... E05D 11/0081 16/223
4,675,940 A * 6/1987 Brockhaus ..... E05D 5/127 16/254
4,839,939 A * 6/1989 O'Brien, II ..... E05D 11/0081 16/223
4,932,795 A * 6/1990 Guinn ..... B63H 20/00 384/276
8,505,164 B2 * 8/2013 Katou ..... E05D 5/062 16/273
9,016,992 B2 * 4/2015 Alvarado, Jr. ..... F16B 4/004 411/34
10,488,074 B2 * 11/2019 Yoskowitz ..... F16J 15/062
2002/0112320 A1 * 8/2002 Hayashi ..... B60R 16/0207 16/386
2012/0240350 A1 * 9/2012 Natu ..... E05D 5/14 16/2.2
2014/0213073 A1 7/2014 Harvey

FOREIGN PATENT DOCUMENTS

CN 101260767 A 9/2008
CN 102574444 A 7/2012
CN 201047217 Y 7/2012
CN 204960601 U 1/2016
DE 19707594 A1 * 10/1997 ..... H02B 1/16
DE 19841809 A1 3/2000
DE 19960736 C1 7/2001
EP 2476566 A1 7/2012
JP H0960397 A 3/1997

* cited by examiner

HINGE

CROSS-REFERENCE TO RELATED APPLICATIONS

The present application claims priority 35 U.S.C. § 119 to European Patent Publication No. EP 17207673.9 (filed on Dec. 15, 2017), which is hereby incorporated by reference in its entirety.

TECHNICAL FIELD

Embodiments relate to a hinge to pivotably connect a motor vehicle door to the body of the motor vehicle.

BACKGROUND

To fix movable vehicle parts, such as for example, doors and tailgates, to a body of a motor vehicle, it has been known for a long time to use hinges. Recently, it is also known to make the entire hinge or at least the hinge bushes out of plastic, whereby inter alia a lower weight of the component can be achieved.

Hinges which may be composed of plastic are known, for example, from German Patent Publication No. DE 101 18 301 A1 or German Patent Publication No. DE 10 2011 100 048 A1.

Plastic bushes, however, when used in vehicle construction, have a serious disadvantage. For instance, during the conventional painting of bodies and doors which are mounted via hinges with plastic bushes, cathodic dip coating is performed. During the cathodic dip coating, because of the inadequate electrical conductivity between the hinge halves and the resulting arcing, a high number of painting defects, known as "blisters" occur, leading to undesirable retouching work and corrosion problems.

The conductance of these plastic bushes may indeed be increased by using more electrically conductive materials, in particular, by adding carbon to the material of the hinge. This in turn, however, leads to excessive adhesion of the cathodic dip coating in the outer region of the hinge. The attached cathodic dip coating may then detach on movement of the hinge and, for example, cause contamination to the vehicle body. This process, therefore, also requires undesirable retouching work after the painting process.

SUMMARY

Embodiments herein relate to a hinge having an electrically insulating bushing which is more suitable for cathodic dip coating, and a method for producing such a hinge which comprises cathodic dip coating having a low defect rate.

Embodiments herein relate to a hinge to pivotably connect a motor vehicle door to a body of the motor vehicle, the hinge comprising at least one of: a first hinge half rotationally connected to a bolt or is formed integrally with the bolt; a second hinge half; a bushing, composed of an electrically insulating material, such as, for example, a plastic, arranged on the second hinge half so that the second hinge half is mounted pivotably on the bolt via the bushing; and an electrically conductive component arranged between the bolt and the second hinge half so as to bridge the bushing such that an electrical contacting occurs between the bolt and the second hinge half.

In accordance with embodiments, an electrically conductive component may be arranged between the bolt, which is connected to the first hinge half and the second hinge half which is mounted rotatably on the bolt. The electrically conductive component may be inserted, for example, at the length of an axial bushing comprising one or more bushing sections between the first hinge halve and the second hinge halve. The electrically conductive component has a higher conductivity than the axial bushing. The axial bushing may comprise a poorly or lowly electrically conductive or insulating material, such as, for example, a plastic material. The electrically conductive component may comprise a highly electrically conductive material, such as, for example, a highly conductive plastic. Alternatively or additionally, the electrically conductive component may comprise a highly electrically conductive material, such as, for example, a highly electrically conductive plastic having a high carbon proportion. Alternatively or additionally, the electrically conductive component may comprise a highly electrically conductive material, such as, for example a highly electrically conductive elastomer having a high carbon proportion.

In accordance with embodiments, the electrically conductive component may have a substantially circular cross-section. The length of the electrically conductive component is to substantially correspond to the thickness of the electrically conductive component. In particular, the electrically conductive component may comprise an O-ring. By using a separate electrically conductive component, the remainder of the bushing may have very low electrical conductivity, i.e., be as electrically insulating as possible.

In accordance with embodiments, a defined current flow between the first hinge halve and the second hinge half is to occur at the electrically conductive component arranged therebetween, or alternatively between the second hinge half and the bolt. In this way, undesirable occurrences of arcing and hence defects in the painting process is prevented. Since the separate electrically conductive component may be deliberately arranged in a suitable position in the intermediate region, increased adhesion of the cathodic dip coating in the outer region of the bushing may also be avoided.

In accordance with embodiments, the bushing may be rotationally connected to the second hinge half or formed integrally therewith. Alternatively or additionally, the bushing may be rotationally connected to the first hinge half. The bushing may also be formed having a bifurcated structure, to include a first radial bushing section rotationally connected to the first hinge half and a second radial bushing section rotationally connected to the second hinge half.

In accordance with embodiments, the bushing may be pressed onto the bolt. In any case, the bushing is to be situated between the bolt and the second hinge half.

The bushing may be formed axially in at least two parts, and the electrically conductive component may be arranged between the at least two parts of the bushing. Particularly, the bushing is made of two parts and the electrically conductive component is arranged in an axial gap between the two bushing sections, and is to make electrical contact with the first hinge halve and the second hinge halve.

In accordance with embodiments, the bushing may be configured axially as one piece and the electrically conductive component may be situated at one axial end of the bushing. The electrically conductive component may extend axially only over a part region of the length of the one-piece or multi-piece bushing.

In accordance with embodiments, the part region may be spaced from the axial end points of the bushing. In that way, no electric current or only minimal current may flow at the end points, to avoid increased adhesion of the paint in this region. The part region may be arranged in the middle of the length of the bushing.

In an operational state, the hinge may be cathodically dip coated.

In accordance with embodiments, a method for producing a hinge may comprise at least one of: rotationally connecting a first hinge half to a bolt (or formed integrally with the bolt); arranging a bushing composed of an electrically insulating material on a second hinge half; connecting the second hinge half to the first hinge half; arranging an electrically conductive component between the bolt and the second hinge half to bridge the bushing such that electrical contact occurs between the bolt and the second hinge half; and cathodically dip-coating the hinge, wherein the bushing is arranged on the second hinge half before or during the connection of the second hinge half to the first hinge half so as to pivotably connect the second hinge half on the bolt via the bushing.

DRAWINGS

Embodiments will be illustrated by way of example in the drawings and explained in the description hereinbelow.

DESCRIPTION

Figure 2:
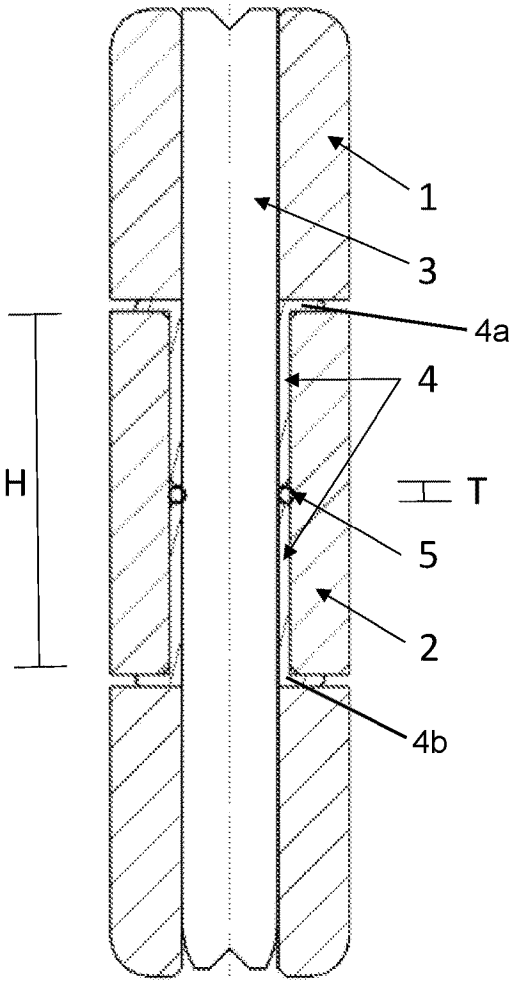
FIG. 2 illustrates a sectional view of a hinge connection along line A-A of FIG. 1.
Figure 1:
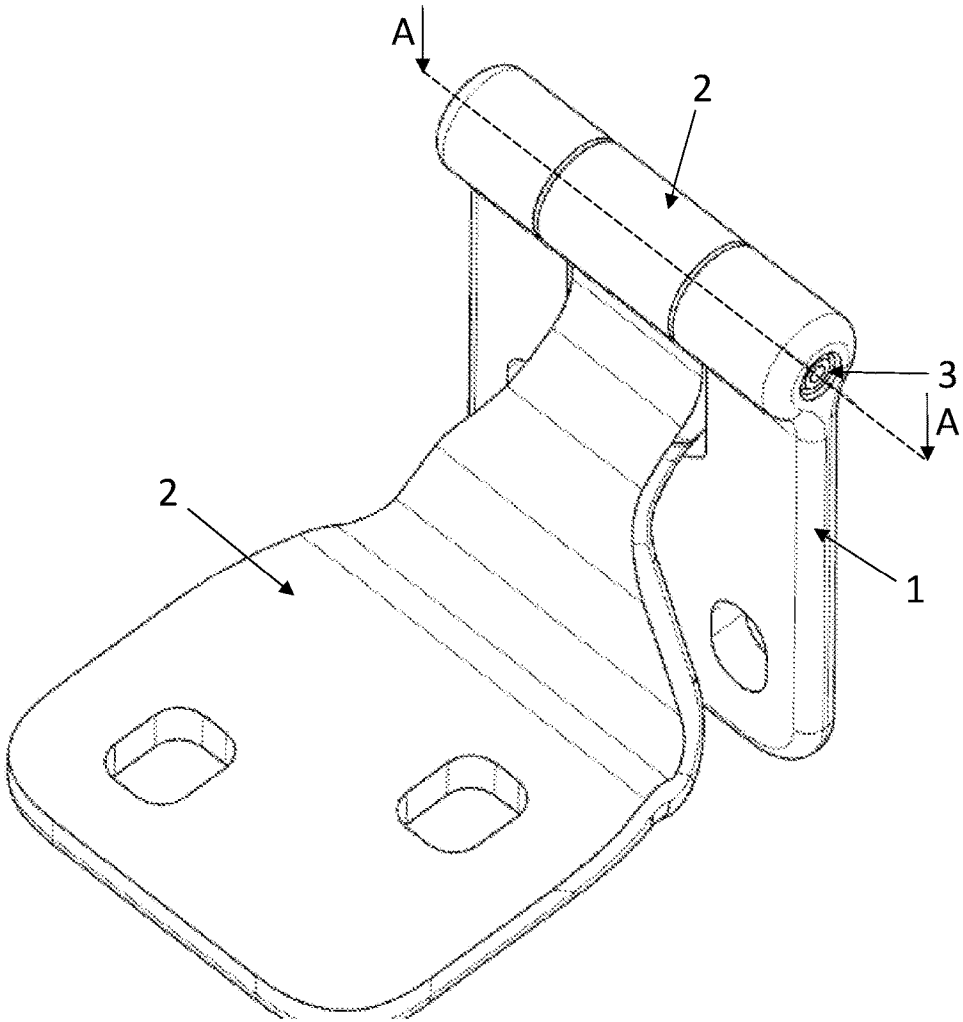
FIG. 1 illustrates a perspective view of a hinge, in accordance with embodiments.
Figure 3:
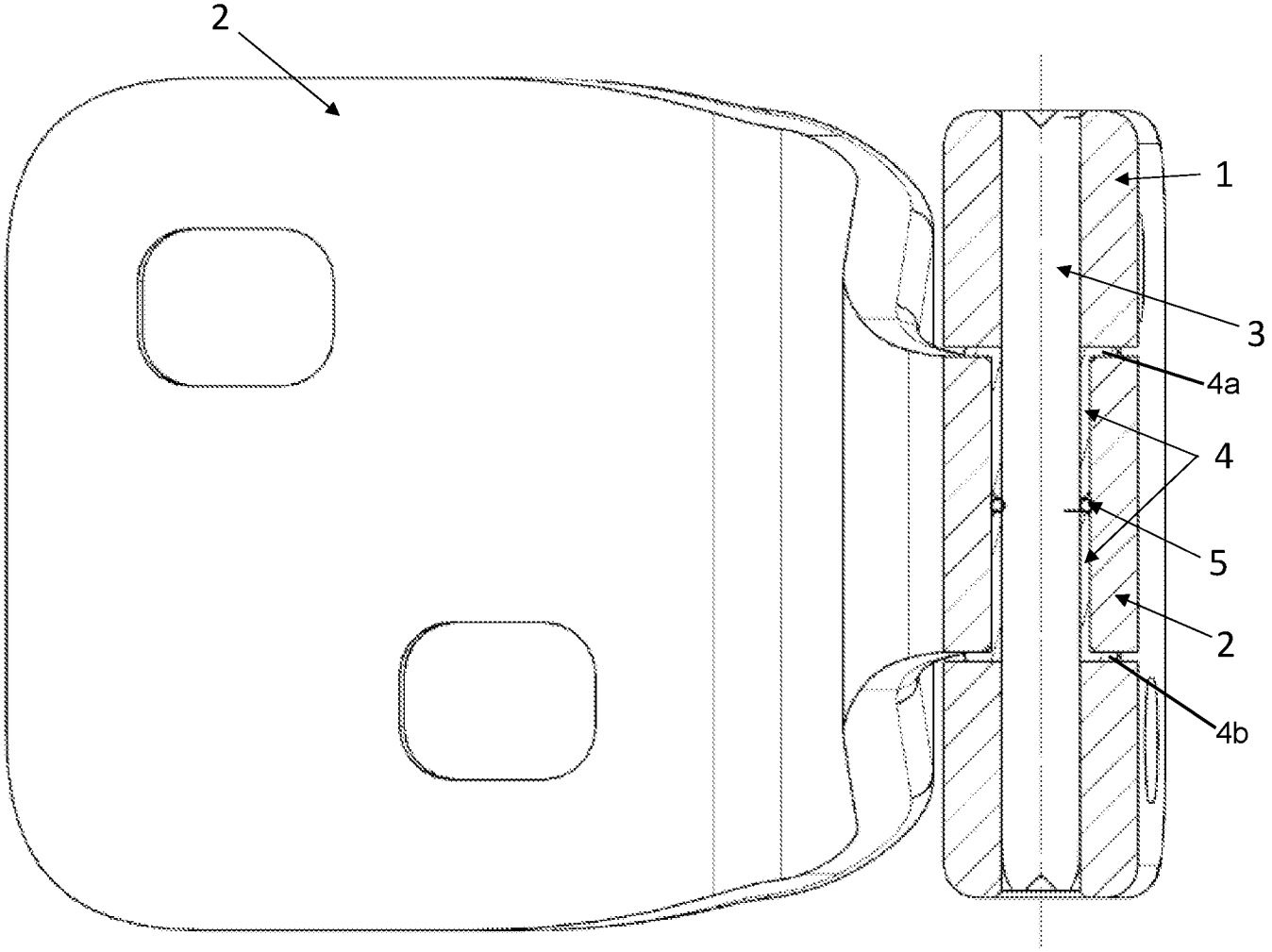
FIG. 3 illustrates a top view of the hinge of FIG. 1 with a section through the hinge connection.

As illustrated in FIGS. 1 through 3, embodiments relate to a hinge suitable to pivotable connect a motor vehicle door or tailgate to a body of the motor vehicle. The hinge comprises a first hinge half 1 and a second hinge half 2, and a bolt 3 rotationally connected to the first hinge half 1. The hinge may be coated via a cathodic dip coating.

In accordance with embodiments, the second hinge half 2 comprises an axial bushing 4 having a bifurcated structure composed of plastic, including a first bushing section 4*a* and a second bushing section 4*b*. The second hinge half 2 is mounted pivotably on the bolt 3 via the bushing 4.

An electrically conductive component 5 is arranged in the plane of the bushing 4 between the second hinge half 2 and the bolt 3. Particularly, the electrically conductive component 5 is positioned axially between the first bushing section 4*a* and the second bushing section 4*b*. The electrically conductive component 5 is to axially extend only over a small region T of the overall length H of the bushing 4, approximately in the middle of the length H of the bushing 4. The electrically conductive component 5 may comprise an O-ring composed of an elastically deformable plastic having a high carbon proportion.

The electrically conductive component 5 may have a thickness that is approximately the same thickness as the bushing 4. The electrically conductive component 5 serves to bridge the bushing 4 to facilitate electrical contact between the first hinge half 1 and the second hinge half 2. Alternatively or additionally, the electrically conductive component 5 serves to bridge the bushing 4 to facilitate electrical contact between the second hinge half 2 and the bolt 3.

Due to the electrically conductive connection between the first hinge half 1 and the second hinge half 2 via the electrically conductive component 5 and/or the second hinge half 2 and the bolt 3, defects during painting are prevented.

The terms "coupled," "attached," or "connected" may be used herein to refer to any type of relationship, direct or indirect, between the components in question, and may apply to electrical, mechanical, fluid, optical, electromagnetic, electromechanical or other connections. In addition, the terms "first," "second," etc. are used herein only to facilitate discussion, and carry no particular temporal or chronological significance unless otherwise indicated.

Those skilled in the art will appreciate from the foregoing description that the broad techniques of the embodiments can be implemented in a variety of forms. Therefore, while the embodiments have been described in connection with particular examples thereof, the true scope of the embodiments should not be so limited since other modifications will become apparent to the skilled practitioner upon a study of the drawings, specification, and following claims.

LIST OF REFERENCE SIGNS

1 First hinge half
2 Second hinge half
3 Bolt
4 Bushing
4*a* First Bushing Section
4*b* Second Bushing Section
5 Electrically conductive component
T Region of length of bushing
H length of bushing

What is claimed is:

1. A hinge to pivotably connect a motor vehicle door to a body of the motor vehicle, the hinge comprising:
- a bolt;
- a first hinge half rotationally connected to a bolt;
- a second hinge half;
- a bushing, composed of an electrically insulating material, arranged on the second hinge half to rotationally connect the second hinge half to the bolt; and
- an electrically conductive component, comprising a plastic having a high proportion of carbon or an elastomer having a high carbon proportion, arranged between the bolt and the second hinge half to bridge the bushing and facilitate electrical contact between the bolt and the second hinge half.

2. The hinge of claim 1, wherein the bushing comprises a first bushing section and a second bushing section, and the electrically conductive component is positioned between the first bushing section and the second bushing section.

3. The hinge of claim 1, wherein the electrically conductive component is axially positioned between the axial ends of the bushing.

4. The hinge of claim 1, wherein the electrically conductive component is axially positioned at a middle of the length of the bushing.

5. The hinge of claim 1, wherein the bushing is rotationally connected to the second hinge half.

6. The hinge of claim 1, wherein the electrically conductive component comprises an O-ring.

7. The hinge of claim 1, wherein the hinge comprises a cathodic dip-coating.

8. A motor vehicle, comprising:
- a motor vehicle body;
- a motor vehicle door; and
- a hinge to pivotably connect the motor vehicle door to the motor vehicle body, the hinge including:
  - a bolt;
  - a first hinge half rotationally connected to a bolt;
  - a second hinge half;
  - a bushing, composed of an electrically insulating material, arranged on the second hinge half to rotationally connect the second hinge half to the bolt; and an electrically conductive component, comprising a plastic having a high proportion of carbon or an elastomer having a high carbon proportion, arranged between the bolt and the second hinge half to bridge the bushing and facilitate electrical contact between the bolt and the second hinge half.

9. The motor vehicle of claim 8, wherein the bushing comprises a first bushing section and a second bushing section, and the electrically conductive component is positioned between the first bushing section and the second bushing section.

10. The motor vehicle of claim 8, wherein the electrically conductive component is axially positioned between the axial ends of the bushing.

11. The motor vehicle of claim 8, wherein the electrically conductive component is axially positioned at a middle of the length of the bushing.

12. The motor vehicle of claim 8, wherein the bushing is rotationally connected to the second hinge half.

13. The motor vehicle of claim 8, wherein the electrically conductive component comprises an O-ring.

14. The motor vehicle of claim 8, wherein the hinge comprises a cathodic dip-coating.

15. A method for producing a hinge to pivotably connect a motor vehicle door to a body of the motor vehicle, the method comprising:

rotationally connecting a first hinge half to a bolt;

rotationally connecting a second hinge half to the bolt via a bushing composed of an electrically insulating material;

positioning an electrically conductive component, comprising a plastic having a high proportion of carbon or an elastomer having a high carbon proportion, between the bolt and the second hinge half to bridge the bushing such that electrical contact occurs between the bolt and the second hinge half; and cathodically dip-coating the hinge.

16. The method of claim 15, wherein the bushing comprises a first bushing section and a second bushing section, and positioning the electrically conductive component comprises positioning the electrically conductive component between the first bushing section and the second bushing section.

* * * * *